US005632921A

United States Patent [19]

Risman et al.

[11] Patent Number: 5,632,921

[45] Date of Patent: May 27, 1997

[54] CYLINDRICAL MICROWAVE HEATING APPLICATOR WITH ONLY TWO MODES

[75] Inventors: Per O. Risman, Harryda, Sweden; Charles R. Buffler, Marlborough, N.H.

[73] Assignee: The Rubbright Group, Inc., Eagan, Minn.

[21] Appl. No.: 463,217

[22] Filed: Jun. 5, 1995

[51] Int. Cl.[6] ..... H05B 6/72

[52] U.S. Cl. ..... 219/750; 219/697; 219/746; 219/756

[58] Field of Search ..... 219/750, 746, 219/756, 762, 690, 695, 696, 697

[56] References Cited

U.S. PATENT DOCUMENTS

| | | | |
|---|---|---|---|
| 3,461,261 | 8/1969 | Lewis et al. | 219/750 |
| 3,590,202 | 6/1971 | Day | 219/750 |
| 4,144,434 | 3/1979 | Chiron et al. | 219/696 |
| 4,276,462 | 6/1981 | Risman | 219/748 |
| 4,336,434 | 6/1982 | Miller | 219/10.55 F |
| 4,490,923 | 1/1985 | Thomas | 34/1 |
| 4,580,024 | 4/1986 | Thomas | 219/10.55 E |
| 4,593,169 | 6/1986 | Thomas | 219/10.55 R |
| 4,631,380 | 12/1986 | Tran | 219/10.55 A |
| 4,728,522 | 3/1988 | Wear | 426/242 |
| 4,785,726 | 11/1988 | Wear | 99/451 |
| 4,883,570 | 11/1989 | Efthimion et al. | 219/686 |
| 5,237,139 | 8/1993 | Berg | 219/10.55 A |
| 5,471,037 | 11/1995 | Goethel et al. | 219/750 |

OTHER PUBLICATIONS

One page, two photographs of a grain dryer believed to be useful as a microwave grain dryer in the practice of the process of U.S. patent 4,728,522 and the apparatus of U.S. patent 4,785,726, dated before Jun. 5, 1995.

*Primary Examiner*—Philip H. Leung
*Attorney, Agent, or Firm*—Faegre & Benson

[57] ABSTRACT

A microwave applicator including a generally cylindrical microwave containment chamber, a microwave energy source, and a feed structure connecting the microwave energy source to the containment chamber. The diameter of the containment chamber is designed according to a process that need only take into account supporting a microwave pattern having substantially only two transverse magnetic modes, each with a characteristic guide wavelength, where the guide wavelength of one mode is substantially equal to twice the guide wavelength of the other mode. Additionally, the interior diameter can be sized to minimize the index subscript numbers of the transverse magnetic modes. The feed structure of the applicator includes at least two feed apertures spaced physically apart around the cylindrical axis of the applicator by a physical angle equal to an electrical phase shift angle of the microwaves introduced through the respective apertures, which in a preferred embodiment is 90 degrees.

39 Claims, 5 Drawing Sheets

CYLINDRICAL MICROWAVE HEATING APPLICATOR WITH ONLY TWO MODES

FIELD OF THE INVENTION

The present invention is directed to a microwave applicator. More specifically, the invention is directed to a high efficiency generally cylindrical microwave applicator having a specially sized microwave containment chamber with low leakage and a feed system which provides a rotating field without moving parts for even heating of a load.

BACKGROUND OF THE INVENTION

As is well-known, electromagnetic waves can transport and deliver energy to an object or load. Microwave applicators using electromagnetic waves in a frequency range of 300 MHz to 300 GHz generally include a microwave energy source, a microwave containment chamber, and a microwave feed structure coupling the energy source to the microwave containment chamber.

A preferred microwave energy source for the present invention is a magnetron operating at 2450 MHz, although it is to be understood that since 915 MHz is an approved microwave cooking and heating frequency, the present invention is adaptable to operation at 915 MHz, and any other microwave frequency desired, according to the teachings hereof.

The volumetric space within a microwave containment chamber is a cavity in which the load (the object or substance to be heated) is placed.

One of the most significant problems with prior art microwave applicators is uneven temperature distribution in the load. Uneven heating is mainly due to three causes: mode-related hot and cold spots, edge overheating, and underside underheating.

Each mode has a respective vertical guide wavelength $\lambda_g$. When modes in a system can be excited so that the modes do not couple to each other even if the system is lossy, the modes are called orthogonal modes.

In the prior art, hot and cold spots occurred because of the uneven energy distribution particular to the modes in the cavity of the applicator. The electric and magnetic field configuration of a mode is dependent on the operating frequency and the dimensions of the cavity.

There are two distinct classes of modes, transverse magnetic (TM) modes and transverse electric (TE) modes. TE modes have no electric or E field component in a direction of propagation, while TM modes have no magnetic or H field component in the direction of propagation.

TE and TM modes are labelled as $TE_{mn}$ and $TM_{mn}$. For a rectangular waveguide, the subscripts indicate the number of half-period variations of a mainly transverse field vector along paths parallel to a wide wall (m) and a narrow wall (n). In a rectangular coordinate system, the m and n subscripts conventionally refer to the x and y axes, with propagation occurring along the z axis.

In a cylindrical cavity it is convenient to use a polar coordinate system. In the present invention, the direction of propagation is along a z axis parallel to the longitudinal cylindrical axis of the cylindrical cavity. In a circular cross-section waveguide or cavity, i.e., one having a generally circular wall concentric to the direction of propagation of microwave energy in the waveguide or cavity, the subscript or index m indicates the number of full-period variations of a transverse field vector along a circular path concentric with the wall. Subscript or index n indicates the number of reversals plus one of the same vector along a radial path in the cavity.

The traditional solutions to avoid mode-related hot and cold spots were either to use a mechanical device (e.g., a turntable) to move the load in relation to the cavity during heating or to use a "mode stirrer" to continually alter the mode patterns within the cavity. Mode stirrers are typically fan-shaped mechanically rotating structures with metal blades placed either inside the cavity or in a separate open feedbox adjacent the cavity. Some designs have attempted to reduce hot and cold spots by using devices such as multiple feed arrangements or rotating antennae.

There continues to exist a need for an efficient microwave applicator that offers convenient and reliable time-averaged uniformity of microwave heating.

Edge overheating (hot spots on the edges of the load) occurs due to the direct coupling of an E field component parallel to an edge of the load, and becomes more significant when the load has a high permittivity.

In most microwave ovens, the loads are generally dielectrics, such as food, with a rather high relative permittivity. The microwave modes interact with the high $\epsilon$ load to transfer energy into the load $\epsilon$.

It is important to understand that the H field intensity in the load and the heating pattern are directly related. Maxwell's equations reveal that energy absorption of the load is generally through the electric E field. Prior art applicators attempt to maximize E and H field intensity to maximize energy transfer and minimize cooking time. However, in so doing, the prior art applicators increase edge overheating, and the possibility of microwave leakage.

Another microwave heating problem is low or insufficient "underside" heating of a flat load. Since not much power penetrates through a flat load, the underside of a flat horizontal load is usually poorly and unevenly heated. Absent a microwave feed below the load, "underside" heating requires the load to not extend over the whole cross section of the cavity.

SUMMARY

The present invention is a microwave applicator for evenly heating a relatively flat load, substantially eliminating uneven heating evidenced by hot and cold spots and edge overheating. The applicator uses modes in the cavity that offer high-efficiency by being frequency broadband, maximizing cooking energy in the load, minimizing microwave leakage, and at the same time both reducing load edge overheating and increasing load underside heating. The applicator includes a feed structure that works in conjunction with the cavity modes to evenly distribute energy to the load without any moving parts.

The applicator includes a microwave containment chamber, a microwave energy source, and a feed structure connecting the microwave energy source to the containment chamber. The applicator can also include electronic controls to control the microwave energy source.

The microwave energy source is preferably a magnetron generating microwaves at a predetermined frequency (2450 or 915 Mhz in alternative preferred embodiments). The feed structure guides the microwaves from the energy source to the containment chamber.

The containment chamber is formed of microwave reflective material and is designed to prevent leakage of microwave energy to the environment outside the containment chamber. The chamber has a top wall, a bottom wall and a side wall. The side wall (which is preferably cylindrical) extends between the top and bottom walls, surrounding (and defining) the cavity and is aligned with a longitudinal axis. In contrast to a conventional microwave oven cavity, the containment chamber preferably has a generally circular cross-section normal to the longitudinal axis, however it is to be understood that the cross-section can be shaped as another closed plane figure, such as a polygon having at least five sides, provided that the cavity cross section approximates a circle. The top and bottom walls are preferably characterized by a surface of revolution about the longitudinal axis, and are preferably planar.

The containment chamber has an interior diameter corresponding to an actual or average diameter of the cross section of the chamber and an interior height equal to a distance between the top and bottom walls. In the practice of the present invention, the interior diameter is designed according to a process which takes into account only transverse magnetic modes to support a desired microwave field in the chamber. While the design criteria involve only TM or transverse magnetic modes, it has been observed that the actual modes present in the cavity as a result of using this design technique are of the more complex hybrid mode types which means they are composed of simultaneous TE and TM modes with the same or similar $\lambda_g$.

Nevertheless, in the practice of the present invention, it has been found adequate to use the techniques presented herein to design a cavity capable of supporting a microwave field having only two transverse magnetic modes, with each having a characteristic guide wavelength, where the guide wavelength of one mode is substantially equal to twice the guide wavelength of the other or second mode. Preferably, the interior diameter is sized or chosen to minimize the index subscript numbers of the TM modes used in the design of the chamber.

In a first preferred embodiment, the interior diameter of the chamber is designed to produce a $TM_{02}$ mode as the first mode and a $TM_{11}$ mode as the second mode. At a predetermined frequency of 2450 Mz, the interior diameter of this embodiment is preferably about 9.17 inches (233 mm) and the load height (h) to the top of the load is preferably about 6.28 inches (160 mm).

The microwave applicator of the present invention also preferably includes a shelf (made of borosilicate glass, glass ceramic, or other similar microwave transparent materials) for supporting the load. The shelf is located inside the containment chamber and is generally perpendicular to the longitudinal axis. The shelf is desirably placed at a distance from the top wall such that the load rests at a distance from the top wall substantially equal to an integer multiple of the guide wavelength of the second (shorter) mode.

The side wall of the microwave applicator preferably has a load-insertion opening and a movable door to selectively close the opening. In one embodiment, a slidable drawer can be attached to the door, with the drawer adapted for inserting the load into the containment chamber. When a drawer is used, the shelf is preferably part of or carried by the drawer.

The feed structure of the microwave applicator of the present invention includes a main waveguide, one or more junctions, and a plurality of waveguide feeds. The waveguide feeds are short waveguides each attached on one end to a feed aperture on the containment chamber and on the other end to the main waveguide at a junction (which may be common to both waveguide feeds or a separate junction for each). The feed apertures can be located on the top wall or on an upper portion of the side wall. The feed apertures or ports are to be located at a physical angle (with respect to the longitudinal axis) that is equal to an electrical phase angle by which the microwaves are displaced as they enter the cavity. In a preferred embodiment the first waveguide feed connects into a first feed aperture and the second waveguide feed connects to a second feed aperture in geometric quadrature, that is, the second feed aperture is physically located ninety degrees apart from the first feed aperture, as measured in a plane normal to the longitudinal axis.

Additionally in this embodiment the feed structure includes a phase shift structure to shift the electrical phase of microwaves entering the chamber from the first waveguide feed to be ninety degrees apart from the electrical phase of microwaves entering the chamber from the second waveguide feed. In this way, two streams of microwave energy are provided, with each stream separated both ninety degrees physically and ninety degrees out of phase electrically from the other as they enter the containment chamber.

The phase shift structure can be any conventional means of achieving ninety degrees phase shift between the first and second waveguide feeds. The length of the waveguide feeds from their junction (or the location of respective separate junctions) with the main waveguide to the respective feed apertures can be different such that the second waveguide feed phase shifts the microwaves ninety degrees with respect to the microwaves entering the chamber from the first waveguide feed. Alternatively, the phase shift structure can use a dielectric phase shifter or a ferrite phase shifter, or other phase shifters as are well known in the art. The combined effect of the geometric quadrature and the ninety degree phase shift produces a rotating microwave pattern in the cavity, thus producing more even heating in the absence of physically rotating or moving parts in the feed structure.

DETAILED DESCRIPTION

The present invention is a microwave applicator for providing efficient and even heating to a load by substantially eliminating hot spots and cold spots. In addition, the applicator of the present invention uses cavity modes which substantially eliminate edge overheating, reduce microwave energy leakage, and are highly efficient.

Figure 1:
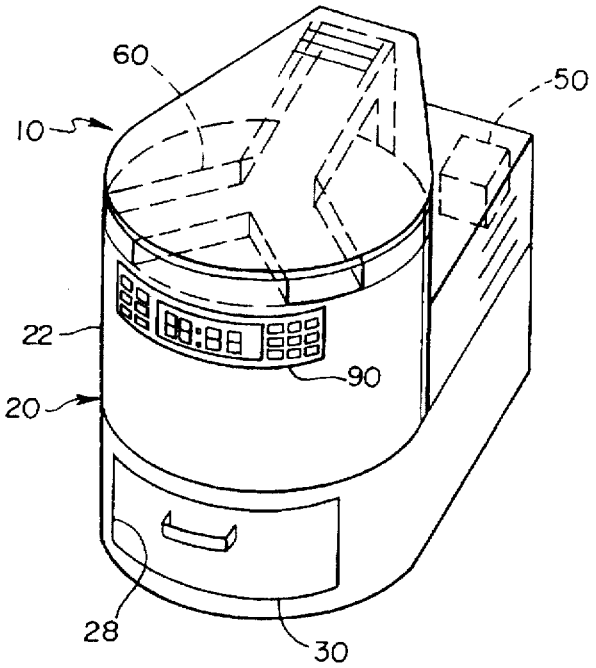
FIG. 1 is a perspective view of a microwave applicator in accordance with the present invention.
Figure 2:
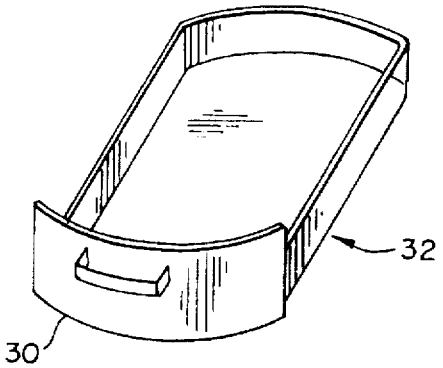
FIG. 2 is a perspective view of the drawer from the microwave applicator of FIG. 1.
Figure 3:
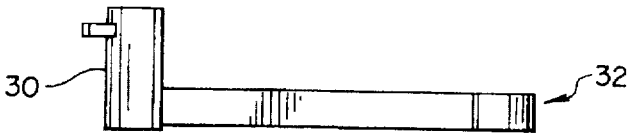
FIG. 3 is a side view of the drawer of FIG. 2.

FIG. 1 illustrates a microwave applicator 10 in accordance with the present invention. The applicator 10 includes a microwave containment chamber 20, an energy source 50 and a feed structure 60 coupling the energy source 50 to the containment chamber 20. The energy source 50 is a magnetron or other source designed to producing microwaves at a predetermined frequency, most commonly at either 2450 or 915 MHz. Electronic controls 90 allow a user to control both the time during which the magnetron is activated and the power setting of the magnetron. Different power settings are usually achieved by periodic on/off duty cycles of the magnetron.

Figure 9:
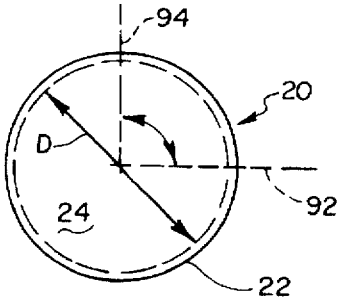
FIG. 9 is a simplified view of the top of a microwave containment chamber showing the axes of entry of a pair of microwave feeds illustrating certain aspects of the present invention.
Figure 10:
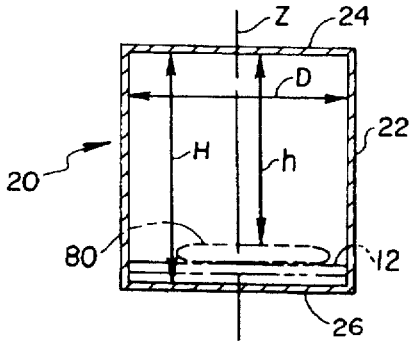
FIG. 10 is a simplified side view in section of the microwave containment chamber of FIG. 9 showing a shelf and load in phantom.

Referring now also to FIGS. 9 and 10, the microwave containment chamber 20 is a container or enclosure made of microwave reflective material such as metal enclosing a cavity in which a load 80 (the substance to be heated) is placed. A typical preferred load 80 for the microwave applicator of the present invention (as shown in FIG. 10) is characteristically flat and horizontally extended, such as a pizza or sandwich. It is to be understood that non-flat loads can also be heated with the applicator of the present invention, but that the benefits of the present invention are best achieved with relatively flat loads. The chamber 20 has a cylindrical longitudinal axis z, a generally cylindrical side wall 22, a top wall 24, and a bottom wall 26.

Microwave applicator 10 also includes a microwave transparent shelf 12 for supporting the load 80. The shelf 12 is located inside the containment chamber 20 and is generally parallel to the top wall 24. In a preferred embodiment, the shelf 12 is made of borosilicate glass, glass ceramic or other microwave transparent materials.

The microwave containment chamber 20 has an interior diameter D, an interior height H, and a load height h. The diameter D is the diameter of a cross-section perpendicular to the longitudinal axis z of the cavity, as may best be seen in FIG. 10. The height H is the distance between the top wall 24 and the bottom wall 26, and is to be understood that H is the "effective" height in the event the top or bottom wall is non-planar. The load height h is the distance from the top wall 24 to the load 80.

Referring now again to FIGS. 1–4, the side wall 22 and the chamber 20 form a right circular cylinder. In other embodiments, the side wall 24 can have a cross section normal to the longitudinal axis z shaped as other closed plane curves or as a higher-order polygon, i.e., a polygon having five or more sides. It is to be understood that such a polygonal embodiment must approximate a circle to some degree to obtain certain benefits of the present invention. Furthermore, it is also to be understood that if a polygon is chosen for the cross section of applicator, a regular polygon (i.e., one with equal sides) is preferred, although it is possible to obtain certain benefits of the present invention with an asymmetrical polygon as well.

Containment chamber 20 has a load-insertion opening 28 in the side wall 22. The opening may be generally quadrilateral or rectangular and is generally normal to the longitudinal axis z. A movable door 30 is congruent to and selectively closes and seals the opening 28 against microwave leakage. In one embodiment, a slidable drawer 32 for inserting the load 80 into the containment chamber 20 may be attached to the door 30, or may be separately located in chamber 20. The shelf 12 may be located on the drawer 32. Other embodiments can include different door elements, for example, the embodiment shown in FIG. 4 has a planar door 30' secured to a lower housing 36 by a piano hinge 40. The shelf can be a part of the drawer itself or can rest in a selected position in the cavity.

In the practice of the present invention, the interior diameter D of chamber 20 is designed using a technique intended to result in a microwave field in the chamber 20 having only transverse magnetic modes present in any plane normal to the longitudinal axis z. More particularly, containment chamber 20 is sized according to a design which need only take into account supporting a microwave field having only a first TM mode and a second TM mode, where the first TM mode has a guide wavelength that is substantially equal to twice the guide wavelength of the second TM mode. Containment chamber 20 is also preferably sized to tend to minimize the index numbers of the first and the second transverse magnetic modes. Again, it is to be stressed that although the design process is directed to producing only TM modes, the actual field in the cavity of chamber 20 may actually have hybrid modes present, while still achieving the benefits of the present invention.

In one embodiment, the diameter D of containment chamber 20 is substantially equal to 9.17 inches (233 mm). The interior height H of containment chamber 20 is approximately 7.00 inches (178 mm). In this embodiment, the interior diameter D of the chamber 20 is sized to produce a $TM_{02}$ mode as the first mode and a $TM_{11}$ mode as the second mode at the predetermined frequency of 2450 MHz. The first ($TM_{02}$) mode has a guide wavelength $\lambda_{g1}$ that is substantially equal to twice the guide wavelength $\lambda_{g2}$ of the second ($TM_{11}$) mode. The modes have favorable and complementary field patterns.

In containment chamber 20, the shelf 12 is placed to provide a distance h of 6.28 inches (160 mm) from the top wall 24 to the load 80. It has been found preferable for the load 80 to be located at a distance h between the top wall 24 and the top of the load 80 (for a flat, horizontally extending load) substantially equal to an integer multiple of the guide wavelength of the second TM mode. Accordingly, other embodiments can place the shelf at different locations (or at an "average" fixed location) to accommodate loads of assorted thicknesses, keeping in mind the desired integer multiple relationship.

Figure 5:
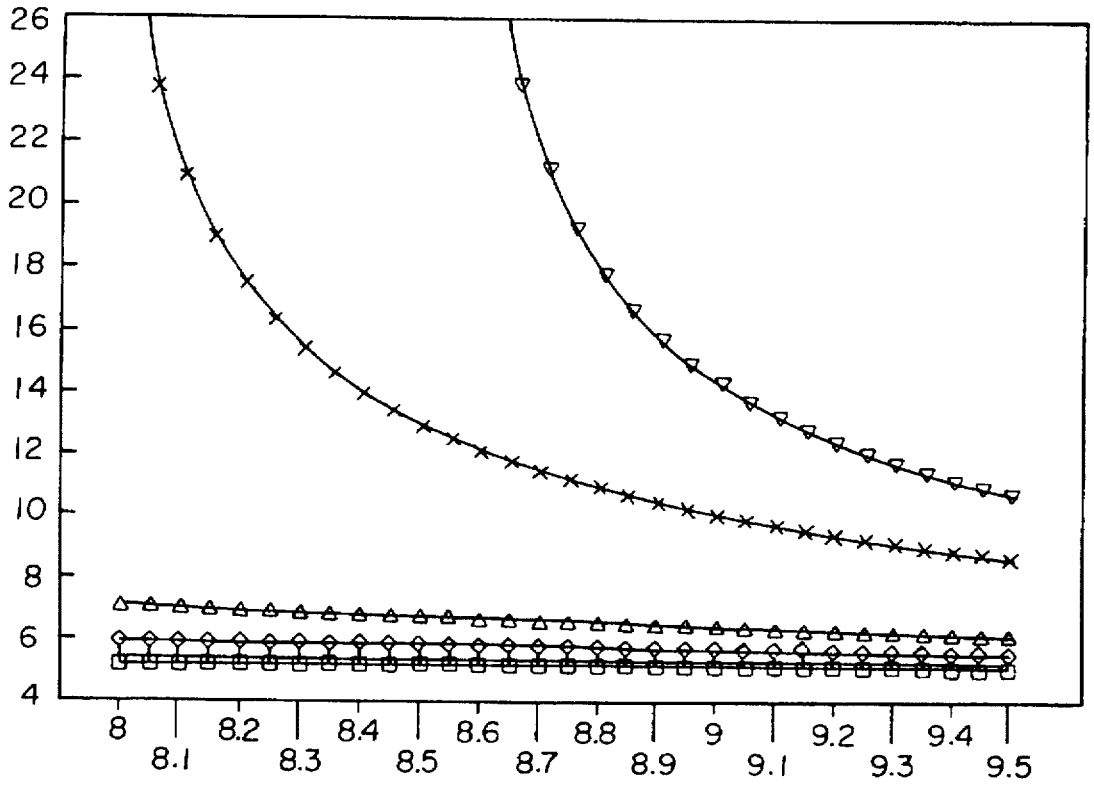
FIG. 5 is a graph representing the relation between the guide wavelength and the waveguide diameter for several modes for a 2450 MHz microwave field.

FIG. 5 illustrates the relationship between the guide wavelength $\lambda_g$ of different modes and the diameter D of a generally circular waveguide. In FIG. 5, the guide wavelength is shown (in inches) along the ordinate or vertical axis and the diameter (in inches) is shown along the abscissa or horizontal axis. The $TM_2$ mode is represented by the curve identified by inverted triangles, while the $TM_2$ mode is identified by "x"s. The upright triangles represent both $TE_{01}$ and $TM_{11}$ modes, while the diamonds represent the $TE_{21}$ mode and the squares represent the $TE_{11}$ mode. The "+"s (between the diamonds and squares) represent the $TM_{01}$ mode. Given the design requirement of the present invention that $\lambda_{g1}=2\lambda_{g2}$, it can be seen that only certain diameter D sizes and first and second TM mode pairs can be selected. The diameter and height information with matching modes is also presented in tabular form in Table 1.

TABLE 1

| FIRST MODE (TM) | SECOND MODE (TM) | CAVITY DIAMETER (D) (inches) | LOAD HEIGHT(h) (inches) | INTERIOR HEIGHT(H) (inches) |
|---|---|---|---|---|
| 21 | 01 | 8.85 | 5.30 | 6.2 |
| 11 | 01 | 6.45 | 5.88 | 6.6 |
| 21 | 11 | 8.43 | 6.72 | 7.5 |
| 02 | 21 | 8.66 | 11.64 | 12.4 |
| 02 | 11 | 9.17 | 6.28 | 7.0 |
| 02 | 01 | 9.53 | 5.23 | 6.0 |

As may be seen, there are other embodiments having different diameters and heights which support other first and second TM modes. For all embodiments, the guide wavelength of the first TM mode is substantially equal to twice the guide wavelength of the second TM mode.

Use of the methodology of the present invention to size the cavity of the containment chamber increases cooking efficiency and reduces edge overheating, because of certain benefits of TM modes present, whether in "pure" form or in a hybrid form.

TE modes have impedances higher than the free space impedance, $\eta_0$, whereas TM mode impedances are lower than $\eta_0$. Since wave reflection at a boundary becomes zero when there is impedance equality across it, TM modes are more favorable for heating purposes, being better suited to match the impedances of common loads, such as food items. Strong standing waves are not required to be built up and the determination of the cavity height and coupling factor for the containment chamber to become efficient at resonance is not as critical as with TE modes. Conditions for reflectionless transmission into a relatively thick load that covers substantially the whole horizontal cross section of the applicator can be established. Reflectionless transmission is highly desirable, since energy reflected back toward the magnetron reduces the efficiency of the applicator.

By sizing the containment chamber 20 to produce only TM modes, the microwave applicator 10 is designed to avoid high horizontal E field components, particularly near the edge regions of the load 80; it being understood that the modes present in the cavity, whether TM or hybrid, have this lack of an E field component. Edge overheating is avoided by designing the microwave field pattern to eliminate (or minimize) any E field component parallel to the edge of the load 80. This condition is achieved when the missing E field component is circumferentially directed, accomplished by selecting a "dominant" or strongly coupled mode having an initial index of zero, e.g., $TM_{02}$. An additional benefit in this case is that leakage is reduced since any existing E fields are perpendicular to the door opening 28. Using a $TM_{02}$ mode alone would result in unacceptable "cold" spots in the center and in a concentric ring or annulus of the heating pattern in the cavity. To correct this, another mode having a "hot" spot in the center of the cavity is selected for use along with the $TM_{02}$ mode. Using a $TM_{11}$ mode will eliminate the "cold" spot in the resulting heating pattern; and, using quadrature feed, the $TM_{11}$ mode is rotated, eliminating azimuthally displaced "hot" and "cold" spots associated with the heating pattern resulting from a simple $TM_{11}$ mode by averaging or integrating the pattern circumferentially, as will be described in more detail hereinafter.

Figure 4:
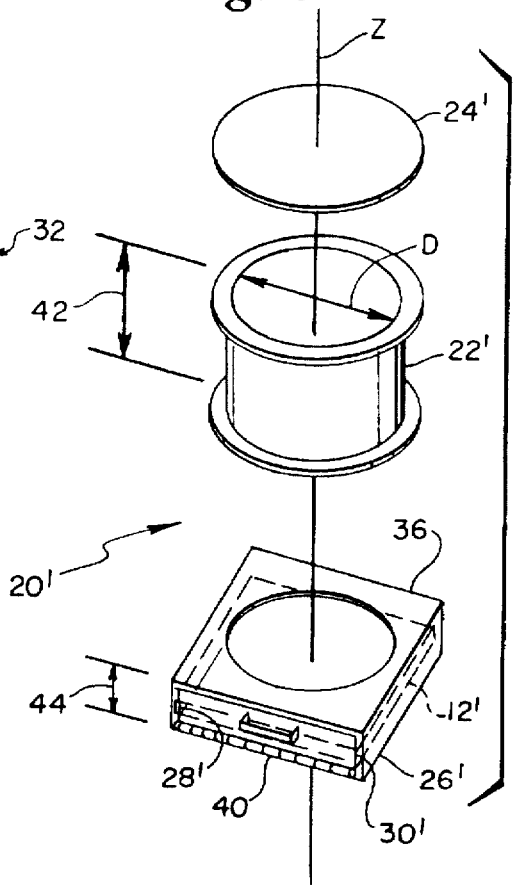
FIG. 4 is an exploded perspective view of another embodiment of a microwave applicator in accordance with the present invention.

FIG. 4 illustrates an exploded view of an alternative embodiment of a microwave applicator 20' having a top wall 24', a cylindrical side wall 22' and a bottom wall 26'. In the Figures, corresponding structures are labelled with the same or primed (apostrophized) reference numbers. In this embodiment, a rectangular lower housing 36 is provided, carrying shelf 12' and door 30' which is secured to housing 36 by the piano hinge 40. It has been found that a relatively short (i.e., less than about 15% of h) rectangular cross section lower housing 36 does not significantly adversely affect performance of the present invention in this embodiment. It may be noted that the dimension H is made up of the height 40 of cylindrical wall 22' plus the height 44 of lower housing 36. Such an approach will simplify the design of the region containing the load, especially the closure or door 30'.

Figure 6:
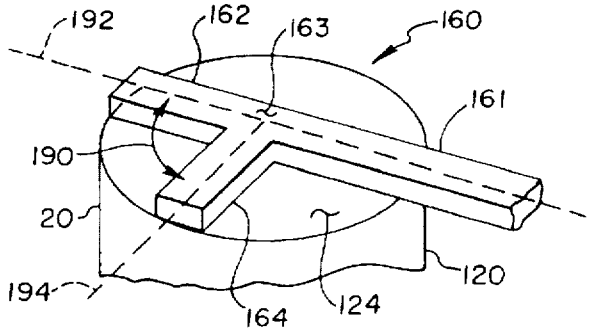
FIG. 6 is a perspective view of a first embodiment of a feed structure in accordance with the present invention.
Figure 7:
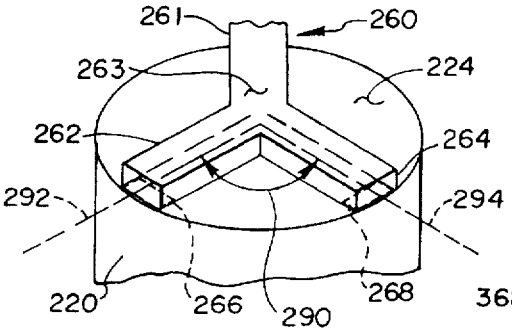
FIG. 7 is a perspective view of a second embodiment of a feed structure in accordance with the present invention.
Figure 8:
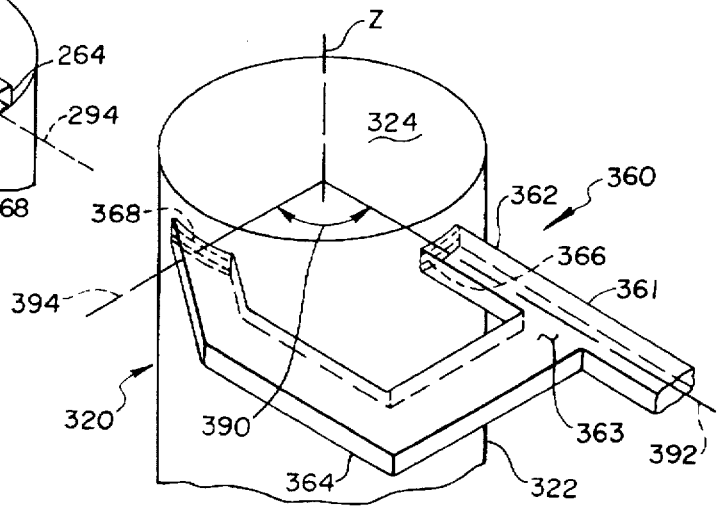
FIG. 8 is a perspective view of a third embodiment of a feed structure in accordance with the present invention.

Referring now to FIGS. 6, 7 and 8, an overall feed structure 160 includes a main waveguide 161, a first waveguide feed 162 extending from the main waveguide 161 at a junction 163, and a second waveguide feed 164 bifurcating from the main waveguide 161 and the first waveguide feed 162 at the junction 163. In this version, the main waveguide 161 is generally parallel to a top surface of top wall 124 and may extend radially away from the containment chamber 120 as shown in FIG. 6, or it may extend along the cylindrical side wall of the chamber, as shown in FIG. 1 in phantom. As shown in FIG. 6, the first waveguide feed 162 extends longitudinally from the main waveguide 161 across the top surface of top wall 124; it is to be understood however that the main waveguide 161 (and waveguide feeds 162, 164) can be positioned as desired with respect to the chamber 120, provided that the feed apertures are properly positioned with respect to the chamber 120. In this embodiment, the second waveguide feed 164 extends perpendicularly from the first waveguide feed 162 across the top surface of the top wall 124, with an included angle 190 of ninety degrees.

Figure 12:
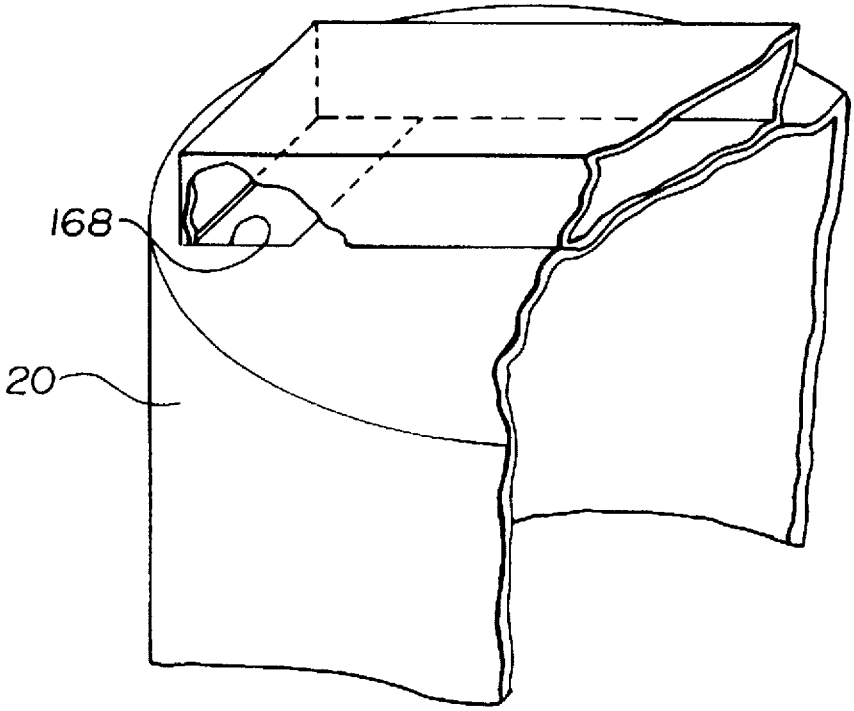
FIG. 12 is a fragmentary enlarged perspective view of a top wall iris feed aperture with a portion of the waveguide feed cut away.

The first and second waveguide feeds 162 and 164 are coupled to containment chamber 120 through feed apertures of the type shown in FIG. 12 as top feed aperture or iris 168 on the top surface of the containment chamber 120. The first feed aperture associated with the first microwave feed 162 is located ninety degrees (indicated by angle 190, and axes 192, 194) from the second feed aperture associated with the second microwave feed 164. This ninety-degree displacement feed aperture arrangement is called geometric quadrature. The axes 92, 94 of the feed apertures may be seen most clearly in FIG. 9.

It is to be understood that the overall feed structure 160 also includes a phase shift structure to phase shift the microwaves entering the chamber from the second waveguide feed 164 ninety degrees with respect to the microwaves entering the chamber from the first waveguide feed 162. In feed structure 160, the phase shift structure includes the junction 163, the first waveguide feed 162, and the second waveguide feed 164, with the length of each of the waveguide feeds 162 and 164 from the junction 163 to the respective feed apertures 166 and 168 sized such that the second waveguide feed 164 phase shifts the microwaves ninety degrees electrically with respect to the microwaves entering the chamber 120 from the first waveguide 162. In this way, the two waveguide feeds 162 and 164 couple microwaves into the containment chamber 120 displaced ninety degrees from each other both physically and electrically. Because of the vectorial addition property of orthogonal modes, the resulting linearly polarized mode is continuously rotated, as will be described in more detail with respect to FIGS. 15–18.

FIG. 7 illustrates a second embodiment of a feed structure 260. Feed structure 260 includes a main waveguide 261 having a junction 263 bifurcating into a first waveguide feed 262 positioned along an axis 292 and a second waveguide feed 264 positioned along an axis 294. The first and second waveguide feeds 262 and 264 may, but do not necessarily, extend generally parallel to the top wall 224. The first and the second waveguide feeds 262, 264 are connected to feed apertures 266, 268 respectively, which are placed on the top wall 224 in geometric quadrature with respect to each other, indicated by the right angle 290 between axes 292 and 294 (with each preferably having an aperture corresponding to iris 168 of FIG. 12 to couple energy to chamber 220). In addition, the first and second waveguide feeds 262 and 264 are sized so that the microwaves from the second waveguide feed 264 are ninety degrees out of phase electrically with respect to the microwaves entering chamber 220 from the first waveguide feed 262.

FIG. 8 illustrates a third embodiment of a feed structure 360. Overall feed structure 360 has a main waveguide 361, a junction 363, a first waveguide feed 362, and a second waveguide feed 364. The first and second waveguide feeds each couple respectively to first and second feed apertures 366 and 368, located in geometric quadrature (i.e., ninety degrees mechanically or geometrically apart, indicated by angle 390 between axes 392 and 394) on side wall 322, with the details of each feed aperture matching that of the iris 368 of FIG. 11.

The main waveguide 361 is generally perpendicular to the longitudinal axis z, projecting radially from side wall 322 of containment chamber 320. At junction 363, the first waveguide feed 362 extends radially inwardly from the main waveguide 361. The second waveguide feed 364 extends from the main waveguide 361 and connects to the second feed aperture 368.

The first and second waveguide feeds 362 and 364 are sufficiently different in length so that the microwaves from the second waveguide feed 364 are ninety electrical degrees out of phase with respect to the microwaves entering chamber 320 from the first waveguide feed 362.

Other embodiments of the feed structure (not shown) may be used which have feed apertures in quadrature, for example, phase shifter structures including a dielectric phase shifter or a ferrite phase shifter.

Figure 11:
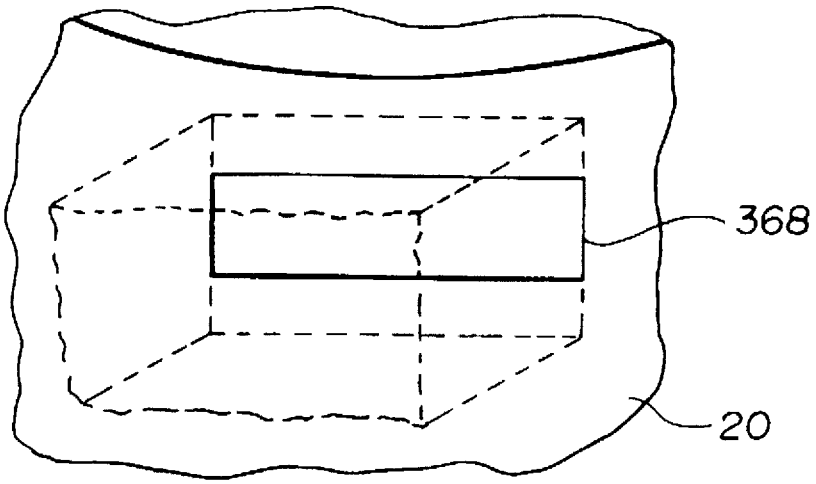
FIG. 11 is a fragmentary enlarged perspective view of a side wall iris feed aperture useful in the practice of the present invention.

It is to be understood that the apertures for coupling microwave energy into the containment chamber from the respective microwave feeds may take other, well-known forms (not shown, for example, a probe projecting into the cavity), alternative to those shown in FIGS. 11 and 12.

Figure 13:
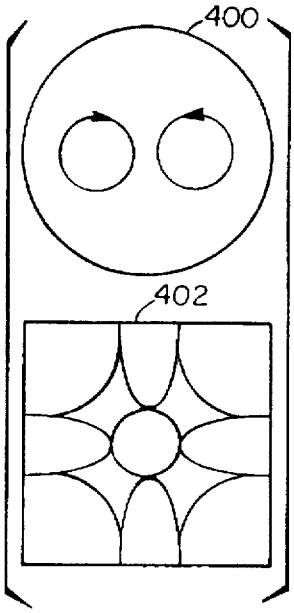
FIG. 13 is a simplified top and side view of a cavity useful in the practice of the present invention showing a $TM_{11}$ mode.
Figure 14:
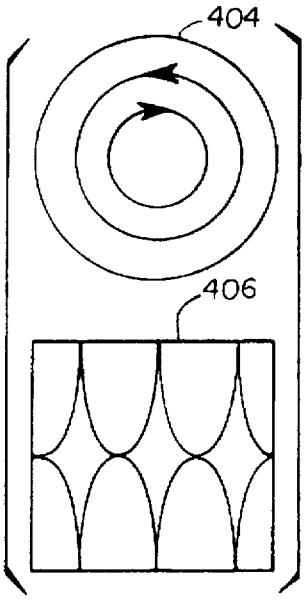
FIG. 14 is a simplified top and side view of the cavity of FIG. 13 showing a $TM_{02}$ mode.

Referring now to FIGS. 13 and 14, a top view 400 and a side view 402 of a cavity containing a $TM_{11}$ mode may be seen with field lines illustrated graphically in a greatly simplified fashion, with top views illustrating magnetic field lines and side views illustrating electric field lines. Similarly, referring to FIG. 14, a top view 404 and a side view 406 of a $TM_{02}$ mode may be seen.

Figure 15:
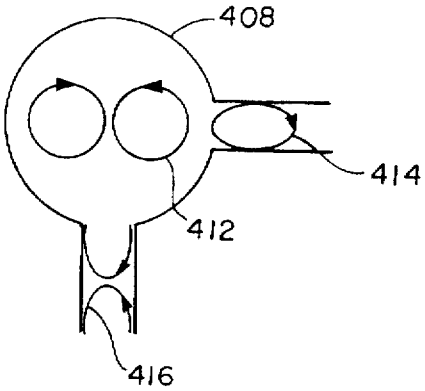
FIG. 15 is a simplified top view of a containment chamber and waveguide feeds showing a $TM_{11}$ mode of the cavity field at a first electrical phase condition of the present invention.
Figure 16:
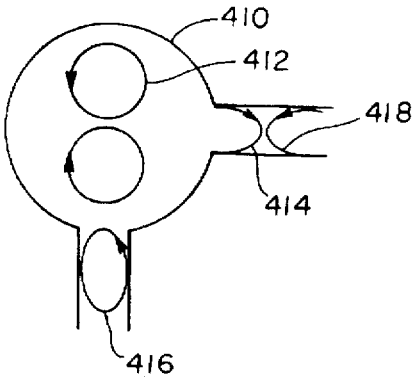
FIG. 16 is a simplified top view similar to that shown in FIG. 15 but with the $TM_{11}$ mode of the cavity field shown at a second electrical phase condition advanced ninety electrical degrees therefrom.
Figure 17:
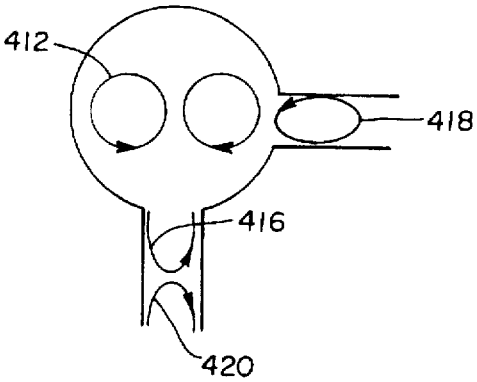
FIG. 17 is a view similar to FIG. 15, except advanced ninety electrical degrees from FIG. 16, thus being 180 electrical degrees advanced from FIG. 15.
Figure 18:
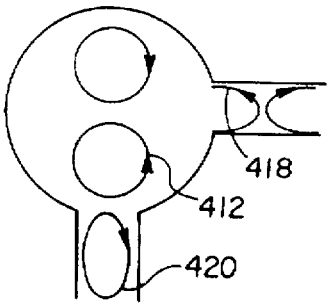
FIG. 18 is a view similar to FIG. 17, except advanced an additional ninety electrical degrees, thus being 270 electrical degrees advanced from FIG. 15.

Referring now to FIGS. 15 and 16, the operation of the rotating field is illustrated in top views 408 and 410 which are to be understood to be representations of the $TM_{11}$ mode at different times, with the different times corresponding to a ninety electrical degree phase shift at the predetermined frequency. As will be apparent, the quadrature feed of the microwave feeds causes the field in the cavity to rotate with magnetic field loop 412 starting at the position shown in FIG. 15, and sequentially moving to the positions shown in FIGS. 16, 17 and 18 with the time between the "snapshots" shown in FIGS. 15–18 corresponding to successive ninety electrical degrees incremental phase change between successive Figures (also indicated by movement of magnetic field loops 414, 416, 418 and 420 in the time succession shown). It is also to be understood that the pattern of FIG. 15 will appear ninety degrees after the time of the pattern shown in FIG. 18, with the sequence repeating for as long as the magnetron is operating.

The present invention has significant advantages over the prior art. By using TM modes in the design process (especially where one has the absence of a circumferential E field component to eliminate edge overheating, particularly in "circular" loads such as pizza and pita bread sandwiches) the present applicator increases cooking efficiency (because TM type modes are better matched than TE type modes to food type loads). The use of the selected TM modes, (where the TM mode pair has degeneracy, i.e., the 2 times relationship of guide wavelengths) in conjunction with a quadrature phase shift feed structure creates an even, time-averaged energy distribution, substantially eliminating hot and cold spots. The phase shift structure of the present invention has no moving parts and is therefore more mechanically efficient and reliable. Finally, the applicator of the present invention offers increased safety by minimizing microwave leakage.

In summary form, the procedure for determining dimensions of a cylindrical cavity is as follows:

1. Choose a circular cylindric mode pair type for their rotational symmetry which can be utilized for uniform heating and electronic stirring.
2. Select only TM modes because of their characteristic high coupling factor resulting in increased efficiency and low edge overheating. Setting m=0 for a $TM_{mn}$ mode will result in a pattern having an absence of an E field component in the circumferential direction, which is advantageous for eliminating edge overheating, but disadvantageous in that such a pattern (by itself) will have undesirable "cold" regions. For example, the $TM_2$ mode will have a central "cold" spot and a concentric annular "cold" ring shaped region. The second mode to be selected is to have a "complementary" heating pattern to the first mode to desirably "fill in" the "cold" spots or regions. For example a $TM_{11}$ mode will have a "hot" center region, and when rotated will provide an even heating pattern without incurring edge overheating.
3. Determine the free space wavelength for the microwave frequency of interest (normally 2450 MHz) and determine the guide wavelengths at that frequency for a range of diameters which encompass the desired cavity diameter for the circularly symmetric TM mode types previously selected.

4. Select the desired mode indices for the first mode to be used, with the lower order mode indices (0 through 4) preferred since they exhibit the most rapid change in guide wavelength as a function of frequency, as indicated in FIG. 5; the $TM_{02}$ mode is preferred because it has circular symmetry in its magnetic field and will provide strong heating at the peripheral region.
5. Select the desired mode indices for the second mode to be used, where the second mode is a TM mode type, and has a guide wavelength equal to one half the guide wavelength of the first mode selected, at an acceptable cavity diameter. For example, at a diameter of 9.17465 inches, the $TM_{02}$ mode has a guide wavelength of 12.55708 inches and the $TM_{11}$ mode has a guide wavelength of 6.27854 inches.
6. For a resonant design, select the cavity height to be equal to the guide wavelength of the first mode selected in step 4 above, allowing the two chosen modes to be degenerate, i.e., to exist in the same cavity at the same time, since the first mode will have a half guide wavelength in the cavity vertically, while the second mode will have a full guide wavelength field distribution vertically in the cavity.

Once the dimensions of the cavity are determined as above, the feed system can be determined according to the following additional step:

7. Provide a quadrature feed system for the cavity wherein the feed ports in the cavity are located in the top wall or in the side wall at or near (i.e., $<<\lambda_g/4$ for the shorter mode guide wavelength) the top wall such that one feed port is located 90 angular degrees from the other feed port, as measured in a plane perpendicular to the longitudinal axis; and provide an electrical phase shift of 90 degrees from the one feed port to the other feed port. It is to be understood that a positive or negative phase shift may be used, with a resulting change in the direction of rotation.

The invention is not to be taken as limited to all of the details thereof as modifications and variations thereof may be made without departing from the spirit or scope of the invention. For example (but not by way of limitation), the load insertion may be by way of an opening in the bottom wall with the shelf moving with the closure of the opening. As another example, feed port spacings other than 90 degrees (but with equal mechanical and electrical angle values) are within the scope of the present invention. As a still further example, it is within the scope of the present invention to utilize an open-ended applicator where one wall, e.g., the bottom wall, is spaced apart from an adjacent wall, e.g., the side wall, provided that means are included to block leakage from between the side wall and the bottom wall.

What is claimed is:

1. A microwave applicator for heating a load, the applicator comprising:
   a) a microwave containment chamber to contain microwaves, the chamber having a top wall, a bottom wall and a generally cylindrical side wall, the side wall connected to the top wall, the containment chamber having an interior diameter;
   b) a microwave energy source for generating microwaves at a predetermined frequency; and
   c) a feed structure connected between the microwave energy source and the containment chamber for coupling microwaves from the energy source to the containment chamber wherein the diameter of the containment chamber is sized to support a microwave field having only first and second transverse magnetic modes, each mode having a respective guide wavelength, and wherein the guide wavelength of the first mode is substantially equal to twice the guide wavelength of the second mode.

2. The microwave applicator of claim 1, wherein the cylindrical side wall has a cylindrical longitudinal axis and a generally circular cross-section normal to the longitudinal axis.

3. The microwave applicator of claim 1, wherein the cylindrical side wall has a longitudinal axis and a polygonal cross-section having at least five sides normal to the axis.

4. The microwave applicator of claim 1, wherein the interior diameter of the chamber is selected to minimize the index numbers of the first and second transverse modes.

5. The microwave applicator of claim 1, wherein the interior diameter of the chamber is sized to produce a $TM_{02}$ mode as the first mode and a $TM_{11}$ mode as the second mode at the predetermined frequency.

6. The microwave applicator of claim 1, wherein the predetermined frequency is substantially equal to 2450 MHz.

7. The microwave applicator of claim 6, wherein the interior diameter is about 9.17 inches.

8. The microwave applicator of claim 6, wherein the cylindrical side wall has an interior height of about 6.28 inches.

9. The microwave applicator of claim 1, further comprising a microwave transparent shelf for supporting the load located inside the containment chamber and generally parallel to the top wall.

10. The microwave applicator of claim 9, wherein the shelf is placed at a distance from the top wall such that the load rests at a distance from the top wall substantially equal to an integer multiple of the guide wavelength of the second mode.

11. The microwave applicator of claim 9, wherein the shelf is made of borosilicate glass.

12. The microwave applicator of claim 9, wherein the shelf is made of glass ceramic.

13. The microwave applicator of claim 1, wherein the cylindrical side wall has an opening and the applicator further comprises a movable door congruent to and selectively closing the opening in the cylindrical side wall.

14. The microwave applicator of claim 13, further comprising a slidable drawer attached to the door, the drawer for inserting the load into the containment chamber.

15. The microwave applicator of claim 1, wherein the bottom wall is shaped to have a surface of revolution about a cylindrical longitudinal axis of the containment chamber.

16. The microwave applicator of claim 15, wherein the interior diameter is selected to support a microwave field in the chamber substantially lacking a transverse electric field component with respect to the cylindrical longitudinal axis.

17. The microwave applicator of claim 16 wherein the microwave field in the chamber lacks a transverse electric field component in the circumferential direction.

18. The microwave applicator of claim 1, wherein the feed structure comprises a first waveguide feed and a second waveguide feed each coupled to the containment chamber and located apart at the points of entry into the containment chamber substantially at a physical angle with respect to each other equal to an electrical phase angle difference between the microwaves at the respective points of entry into the containment chamber.

19. The microwave applicator of claim 18, wherein physical and electrical phase shift angles between the waveguide feeds are each equal to ninety degrees.

20. The microwave applicator of claim 18, wherein each waveguide feed further comprises a feed aperture located on the top wall.

21. The microwave applicator of claim 18, wherein the feed structure includes a main waveguide coupled to the first and the second waveguide feeds and a pair of feed apertures located in the top wall.

22. The microwave applicator of claim 18, wherein the first waveguide feed connects into a first feed aperture on the side wall, and the second waveguide feed connects to a second feed aperture located in the side wall at a physical angle of ninety degrees from the first feed aperture.

23. The microwave applicator of claim 22, wherein the feed structure further includes a phase shift structure to phase shift the microwaves entering the chamber from the second waveguide feed ninety electrical degrees with respect to the microwaves entering the chamber from the first waveguide feed.

24. The microwave applicator of claim 23, wherein the phase shift structure includes a junction connecting the first and the second waveguide feeds and a different length between the first and the second waveguide feeds such that the second waveguide feed phase shifts the microwaves entering the chamber from the second waveguide feed ninety degrees from the microwaves entering the chamber from the first waveguide feed.

25. The microwave applicator of claim 23, wherein the phase shift structure includes a dielectric phase shifter.

26. The microwave applicator of claim 23, wherein the phase shift structure includes a ferrite phase shifter.

27. A microwave containment chamber for a microwave applicator for heating a load, the chamber comprising:

a) a top wall;

b) a bottom wall; and c) a generally cylindrical side wall connected to the top wall, and sealed sufficiently to contain microwaves, the cylindrical side wall having an interior diameter;

wherein the interior diameter of the cylindrical side wall is sized to support a microwave field having first and second transverse magnetic modes, and characterized by the absence of transverse electric modes, each transverse magnetic mode having a respective guide wavelength, and wherein the guide wavelength of the first transverse magnetic mode is substantially twice the guide wavelength of the second transverse magnetic mode.

28. A microwave applicator for heating a load, the applicator comprising:

a) a generally cylindrical microwave containment chamber having a continuous side wall, a generally planar top wall, and a bottom wall, the side wall connecting the top wall and the bottom wall, the top, bottom, and side walls sealed and secured together to contain microwave energy, the containment chamber having an interior diameter;

b) a microwave energy source for generating microwave energy at a frequency substantially equal to 2450 megahertz;

c) a feed structure connected between the microwave energy source and the containment chamber for coupling the microwave energy from the energy source to the containment chamber;

wherein the interior diameter of the containment chamber is sufficiently close to 9.17 inches to support a microwave field having only a $TM_{02}$ first transverse magnetic mode and a $TM_{11}$ second transverse magnetic mode, each mode having a respective guide wavelength, and such that the guide wavelength of the first mode is substantially equal to two times the guide wavelength of the second mode.

29. A method of manufacturing a microwave containment chamber for a microwave applicator, comprising the steps of:

a) forming a generally cylindrical side wall of a conductive material sufficient to contain microwaves, the side wall having two open areas at longitudinal ends thereof and having an interior diameter, wherein the step of forming the side wall includes the step of selecting the interior diameter of the side wall such that introduction of microwaves at a predetermined frequency into the circularly cylindrical side wall produces a microwave field having first and second transverse magnetic modes each having a respective guide wavelength, the first mode having two times the guide wavelength of the second mode such that the combination of the first and second modes provides a substantially even heating pattern;

b) providing a bottom wall and a top wall of a conductive material sufficient to contain microwaves, the bottom and top walls having dimensions at least sufficient to close the open areas of the side wall;

c) connecting the top wall to one of the open areas of the side wall, such that the top wall closes the one open area and connecting the bottom wall to the other open area of the side wall, such that the bottom wall closes the other open area, the top, bottom and side walls together forming a closed-ended generally cylindrical chamber.

30. The method of manufacture of claim 29, wherein the step of selecting the interior diameter of the side wall further comprises minimizing the index numbers of the first and second modes.

31. The method of manufacture of claim 29, wherein the step of selecting the interior diameter of the side wall includes sizing the interior diameter to produces a microwave field having a $TM_{02}$ first transverse magnetic mode and a $TM_{11}$ second transverse magnetic mode.

32. The method of manufacture of claim 29, wherein the step a) includes sizing the interior diameter to be substantially equal to 9.17 inches.

33. The method of manufacture of claim 29, wherein the step of forming the side wall includes providing a side wall having a generally circular normal axis cross sectional profile.

34. The method of manufacture of claim 29, wherein the step of forming the side wall includes providing a cylindrical side wall having a normal axis cross-sectional profile generally shaped as a higher-order polygon.

35. The method of manufacture of claim 29, wherein the step of providing the bottom wall further includes the step of shaping the bottom wall to have a surface of revolution about a longitudinal axis of the containment chamber.

36. The method of manufacture of claim 29, further including the steps of providing a microwave transparent shelf for supporting the load and of positioning the shelf inside the containment chamber and generally parallel to the top wall.

37. The method of manufacture of claim 36, wherein the step of positioning the shelf includes locating the shelf to support the load at a distance from the top wall substantially equal to an integer multiple of the guide wavelength of the second mode.

38. The method of manufacture of claim 29, further including the steps of forming an opening on the side wall, providing a door sized to cover the opening, and attaching the door to the microwave applicator such that the door selectively closes the opening.

39. The method of manufacture of claim 29, further including the steps of:

d) forming an opening on the side wall;

e) providing a door connected to a drawer, including sizing the door to cover the opening and sizing the drawer to fit through the opening; and f) slidably receiving the drawer in the opening such that the door selectively closes the opening.

* * * * *

UNITED STATES PATENT AND TRADEMARK OFFICE

CERTIFICATE OF CORRECTION

PATENT NO. : 5,632,921
DATED : May 27, 1997
INVENTOR(S) : Risman, et al.

It is certified that error appears in the above-indentified patent and that said Letters Patent is hereby corrected as shown below:

Column 2, line 21, insert --ε-- after permittivity.

Column 2, line 22 delete "ε" after load.

Signed and Sealed this

Ninth Day of September, 1997

*Attest:*

*Attesting Officer*

BRUCE LEHMAN

*Commissioner of Patents and Trademarks*